US007089610B2

(12) United States Patent
Zhong

(10) Patent No.: US 7,089,610 B2
(45) Date of Patent: Aug. 15, 2006

(54) PORTABLE HAMMOCK

(75) Inventor: Jianwei Zhong, Zhejiang (CN)

(73) Assignees: Jianwei Zhong, Zhejiang (CN); Zhongmin Cui, Zhejiang (CN)

( * ) Notice: Subject to any disclaimer, the term of this patent is extended or adjusted under 35 U.S.C. 154(b) by 0 days.

(21) Appl. No.: 10/948,812

(22) Filed: Sep. 22, 2004

(65) Prior Publication Data

US 2005/0060802 A1 Mar. 24, 2005

(30) Foreign Application Priority Data

Sep. 23, 2003 (CN) ..... 03 2 70263
Sep. 20, 2004 (CN) ..... 2004 1 0078916

(51) Int. Cl.
*A45F 3/22* (2006.01)
*A45F 3/24* (2006.01)

(52) U.S. Cl. ..... 5/122; 5/127; 5/182

(58) Field of Classification Search ..... 5/120, 5/122, 127, 129, 175, 176.1, 177, 182
See application file for complete search history.

(56) References Cited

U.S. PATENT DOCUMENTS 406,715 A * 7/1889 Fenner ..... 5/99.1
5,113,537 A 5/1992 Turk ..... 5/121
5,983,422 A * 11/1999 Bayless ..... 5/120

* cited by examiner

*Primary Examiner*—Alexander Grosz
(74) *Attorney, Agent, or Firm*—Lumen Intellectual Property Services, Inc,

(57) ABSTRACT

A portable, collapsible hammock for outdoor use has a body support surface being suspended on a position above and not touching the ground. The hammock also has a support frame comprising a pair of inclined upright arms, between which there is at least one X-scissor linkage connecting the arms. There are two connecting means disposed over the upright arms providing connections to the scissor linkage and a pair of legs. One means is a slidable connector disposed over the upright arms and the other means is fixed at the bottom end of the inclined upright arms. There is a leg/upright arm interface provides a three direction hinged joint for the connectors.

10 Claims, 5 Drawing Sheets

PORTABLE HAMMOCK

RELATED APPLICATIONS

This application claims priority under 35 U.S.C. §119(a) for Chinese Patent Applications No. 03270263.9, filed Sep. 23, 2003, titled "Portable Folding Suspended Bed" and No. 200410078916.5, filed Sep. 20, 2004, titled "Portable Folding Suspended Bed."

FIELD OF THE INVENTION

The present invention relates to hammocks. More particularly, the invention concerns a collapsible, easily portable hammock for use in the outdoors such as at the beach, in the park, or in the yard.

BACKGROUND

Hammocks have been known for many, many years, and have been widely used for both recreational and utilitarian purpose. Because of the recreational popularity of hammocks, numerous types of foldable hammock supporting structures for holding the hammock in an outstretched position have been suggested. However, such foldable or collapsible hammock supports are typically complex in construction and are generally heavy and quite bulky when in a collapsed or folded configuration. Accordingly, they are extremely difficult to transport from place to place.

One prior art collapsible hammock is described in U.S. Pat. No. 5,983,422 (refer to FIG. 9). Although it is lightweight in construction, and easy to use, it not suitable for heavy people. The stop pin 58 may be not strong enough to prevent two support arms 50 from rotating inwardly. It would cause the stretched hammock to collapse under the weight of a heavy user. So a risk of safety exists. From this consideration the designers should pay more attention to the problem of making a foldable hammock stronger for supporting heavier person's weight.

It will become more apparent from the discussion that the many efforts should be focused on strengthening the force to resist the inward rotation of two support arms 50, thereby maintaining the rigidity of stretched position of the hammock when a heavier person's weight exerts against the hammock surface.

SUMMARY

It is the object of the present invention to provide an improved collapsible, fully portable hammock which can safely carry a heavier person. The present invention overcomes the drawbacks of the prior art collapsible hammock by providing a novel design.

DESCRIPTION

Figure 1:
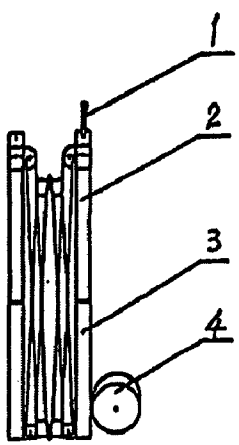
FIG. 1. is a side view of the apparatus with two X-scissor linkages in series as it appears in a full folded configuration. It is first embodiment of the present invention.
Figure 3:
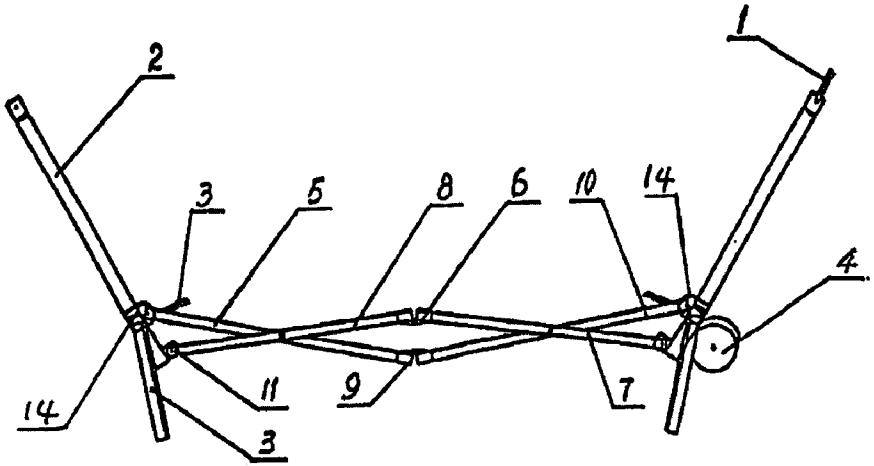
FIG. 3 is an side view of the first embodiment in its full-stretched configuration, showing the bed surface removed from the support frame.
Figure 2:
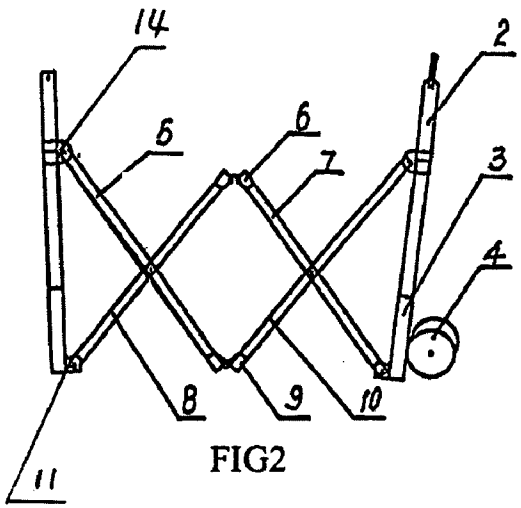
FIG. 2 is an side elevation view of first embodiment in its semi-stretched position.
Figure 4:
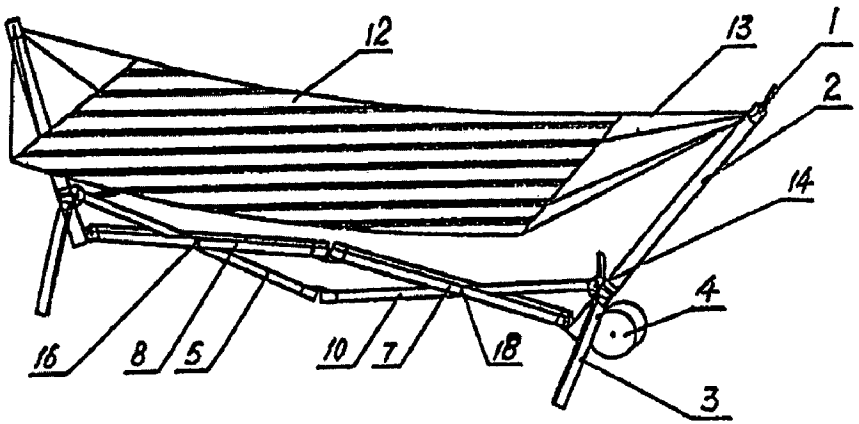
FIG. 4 is a perspective view of first embodiment in its full-stretched configuration.

Refering to FIGS. 1–4, they show a hammock of a first embodiment of present invention. In the form of the invention shown in the drawings, the apparatus includes two major components namely a hammock body support assembly, which includes a flexible body support surface 12 and fastening rope 13, and a support frame. As best seen in FIGS. 1–4, the support frame here comprises a first upright arm 2 and a second upright arm 2'.

Each upright arm provides a top-positioned hook 1 and 1' to receive a fastening of the rope 13. A rigid width maintaining bar 21 is disposed at each end of the flexible body support surface 12. Using the rope 13 and a rigid width maintaining bar 21, the flexible body support surface 12 is secured with a hook 1, which is disposed on the top of the upright arm 2. The hammock body support surface 12 is attached to and between said first and second upright arms 2 and 2'.

A first angle measured from the ground plane to a first upright arm 2 has a range of 45 to 85 degrees, and a second angle measured from the ground plane to the second upright arm 2' has a range of 45 to 85 degrees. Two X-scissor linkages in series are attached to and between the first upright arm 2 and the second upright arm 2'.

The first X-scissor linkage consists of the bars 5 and 8, which intersect at hinge 16. The second X-scissor linkage consists of the bars 7 and 10, which intersect at hinge 18. The first X-scissor linkage is connected with the second X-scissor linkage through the upper hinge 6 and lower hinge 9.

A first leg/upright interface 14 is lockably and slidably disposed over the first upright arm 2, and the second leg/upright interface 14' is lockably and slidably disposed over the first upright arm 2'. The first X-scissor linkage is linked with the first leg/upright interface 14 with the bar 5. The second X-scissor linkage is linked with the second leg/upright interface 14' with the bar 10. A pair of legs 3 and 3', respectively hinged at a pair of plates of the leg/upright interface 14 and 14', keep an "A" shaped position standing on the ground. The legs constitute a mechanism which can change and adjust the angles of the leg's "A" shape by placing the lock pin 24 in different lock holes 23. The legs can form different lockable shapes against the ground, and they can facilitate the suitability of the leg positions according to different ground conditions. The variable leg positions can be used on inclined and rugged ground surfaces.

A hammock with two X-scissor linkages in series between first and second upright arms 2, 2' has the advantage that the length of the body support surface 12 can be enough long to comfortably carry a person, while the size of the folded configuration is small. It is convenient to transport and to store the folded hammock. There may be one or more wheels 4 attached to a bottom part of the upright arm 2', which provides easy transporting and storing.

Figure 6:
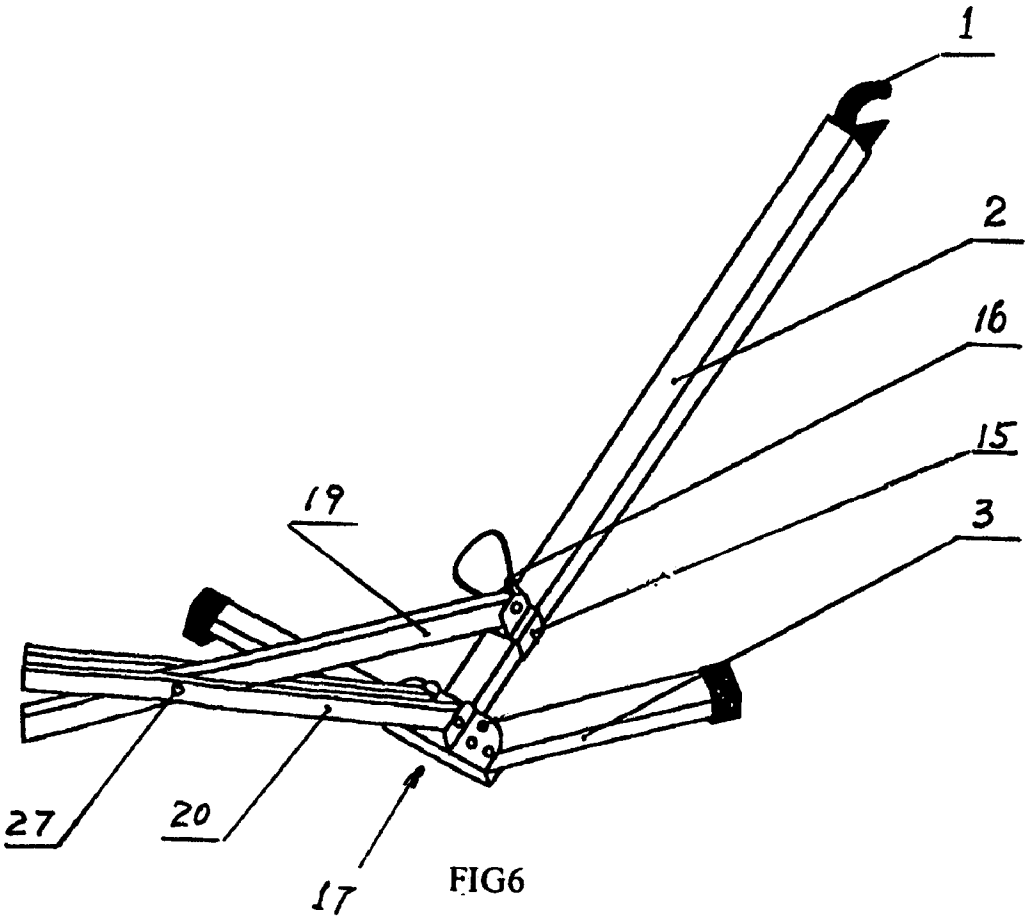
FIG. 6 is a local enlargement perspective view of the second embodiment reflecting the connection and locking relationship between the upright support, X-scissor, and a pair of legs.
Figure 5:
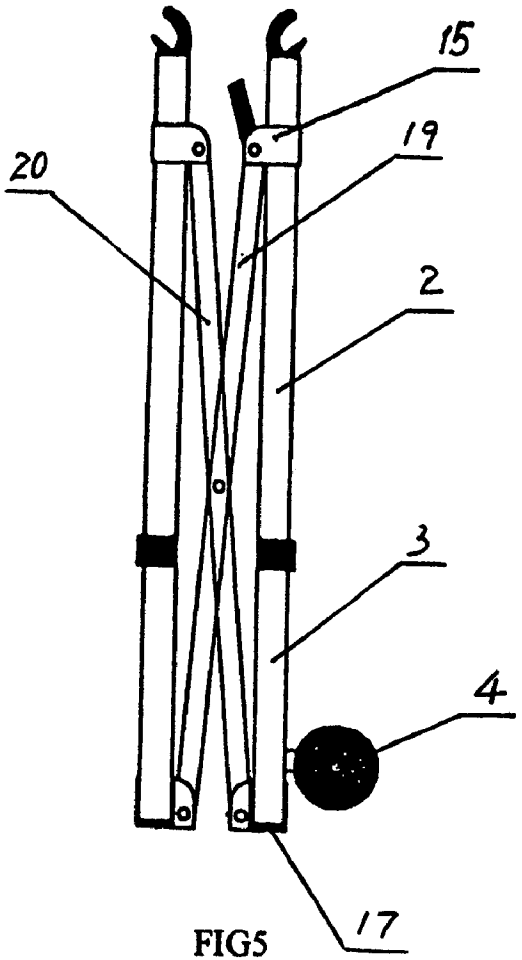
FIG. 5 is an side view of the second embodiment with a single X-scissor linkage.

The FIG. 5 shows a collapsed position of a second embodiment of present invention. The FIG. 6 is a local perspective view of a hammock of the second embodiment of present invention.

This portable collapsed hammock comprises first and second upright arms 2 and 2' and one X-scissor linkage in between. The X-scissor linkage is consists of the bars 19, 20, which are intersected at the hinge 27. The upright arms 2 and 2' each have a bottom positioned leg/upright arm interface 17 and a lockable sliding collar 15, which is slidably disposed over the leg/upright arm interface 17.

The X-scissor linkage consists of the bars 19, 20, which are connected at a hinge 27. The X-scissor linkage is hingedly attached to the lockable sliding collar 15 and the leg/upright arm interface 17, respectively, through the upper end of the bar 19 and the lower end of the bar 20 using a hinge pin.

Over the sliding collar 15 there is a stop pin 16 being inserted in a through hole (not shown, also known as a lock hole) disposed on the inward facing wall of the upright arms 2 and 2' providing a mechanical stop for the respective lockable sliding collars 15 to prevent the upright arms 2 and 2' coming closer together when the user's body weight pressed on the surface 12. It is the upward movement of the sliding collar 15 that is stopped by the stop pin 16.

The upper end of bar 19 is connected to the sliding collar 15 with a hinge pin (not shown). When the hammock is being folded, the sliding collar 15 is moving from the lower position to the top position (refer to FIG. 5) of the upright arms 2 and 2'.

Figure 7:
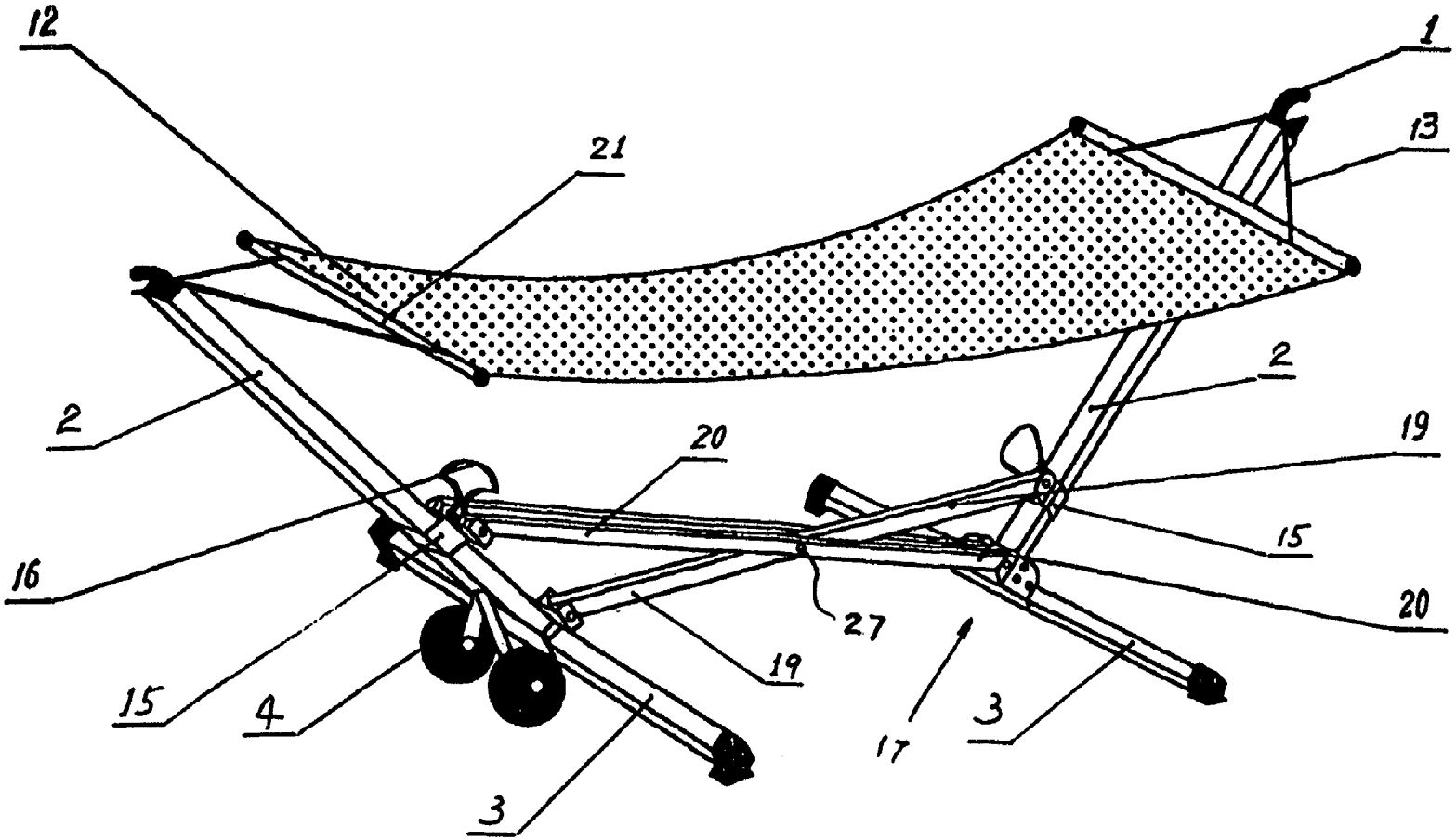
FIG. 7 is a perspective view of the hammock of second embodiment.

FIG. 7 is a perspective view of the hammock in second embodiment of present invention. It illustrates the fully stretched, and operational, position of the hammock.

Figure 8:
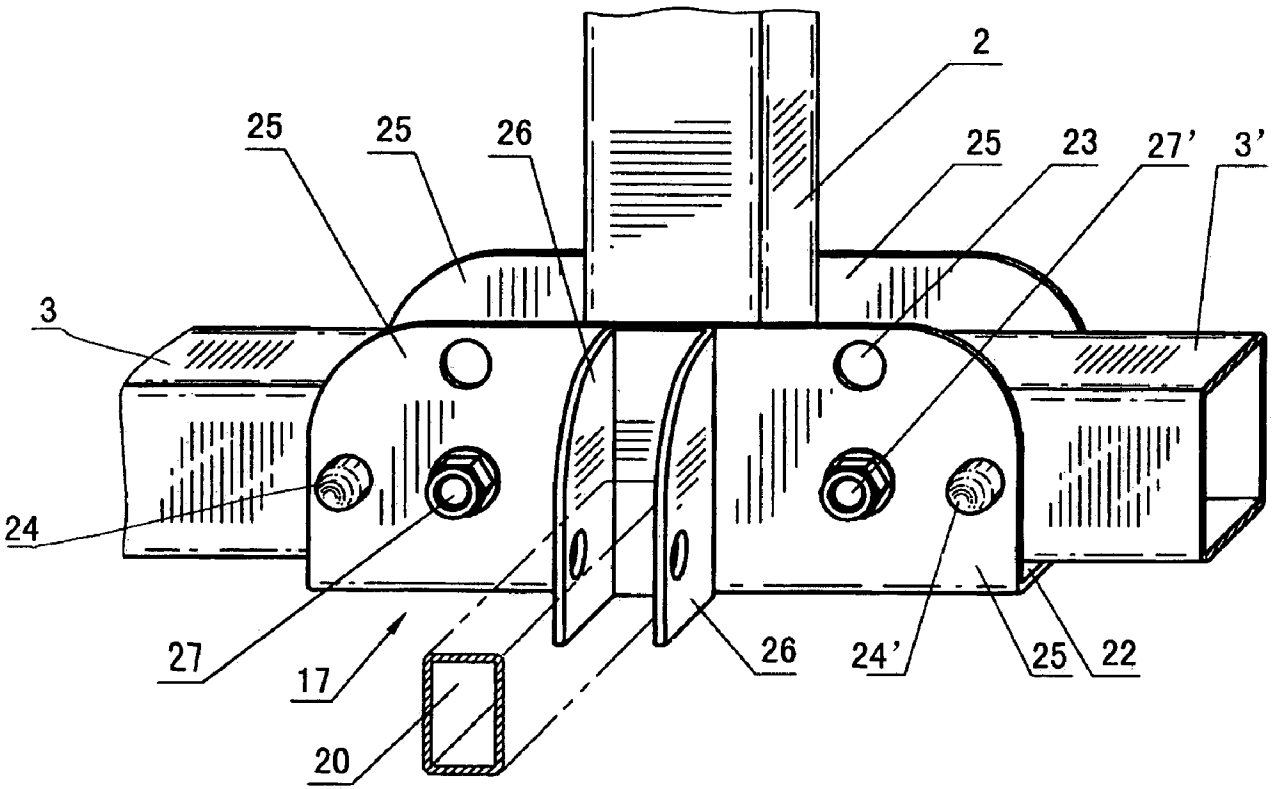
FIG. 8 is a perspective view of the leg/upright interface member.
Figure 9:
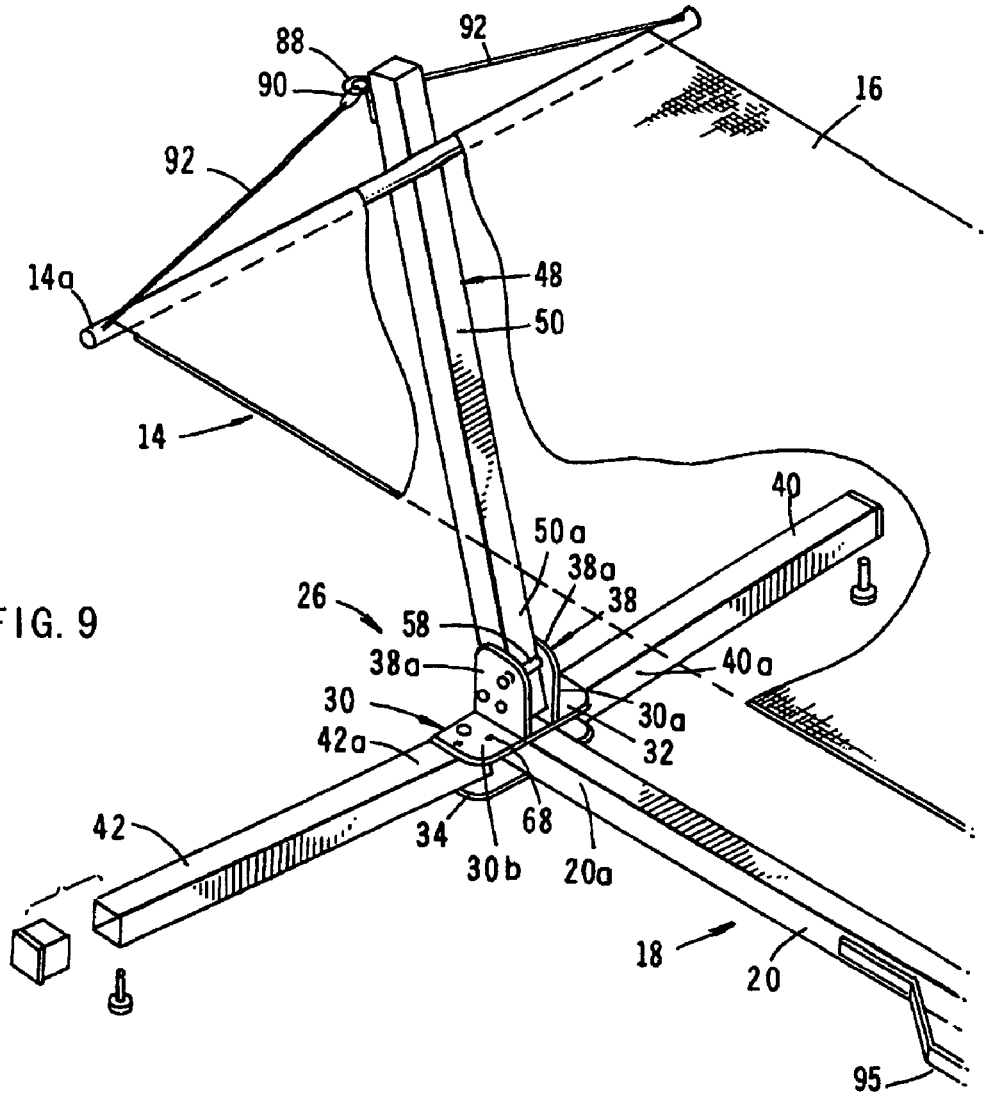
FIG. 9 (Prior Art)
FIG. 9 is a perspective view of a hammock in prior art.

FIG. 8 shows the bottom positioned leg/upright arm interface 17 comprises three pairs of plates 25, 26 forming three-directional hinge joint. The two pair of plates 25 provide two legs 3, 3' rotational freedom in a plane inclined from the vertical plane. The pair of plates 26 provides rotational freedom in the vertical plane to the bar 20 of the X-scissor linkage. When the two legs 3, 3' are fully stretched open, they align in a straight line with the seat 22. Thus, they are in the ground engaging position along with the seat 22.

The legs 3 and 3' are respectively rotatable around the hinge pins 27 and 27'. There are two pair of lock holes 23 that are disposed on a pair of plates 25 for accommodating the spring biased lock pin 24. The upright arms 2 and 2' intersect with the seat 22 of their respective leg/upright arm interfaces 17.

The leg/upright arm interface 17 of the second embodiment and the leg/upright arm interface 14 of the first embodiment is the same interface member. In the first embodiment, the leg/upright arm interface 14 has its seat 22 on the top end (i.e. up-oriented, or top-oriented). In the second embodiment, the leg/upright arm interface 17 has its seat 22 on the bottom end (i.e. ground-oriented, or bottom-oriented).

Having now described the invention in detail in accordance with the requirements of the patent statutes, those skilled in this art will have no difficulty in making changes and modification to the individual parts or to their relative assembly in order to meet specific requirement or conditions. Such changes and modifications may be made without departing from the scope and spirit of the invention, as set forth in the following claims.

We claim:

1. A portable hammock comprising:

a hammock body support surface (12); and a support frame comprising:

a first upright arm (2) having the first and second legs (3) attached thereto;

a second upright arm (2) having the third and fourth legs (3) attached thereto; and at least one X-scissor linkage disposed between said first and second upright arms (2), where said first and second upright arms are attached to said at least one X-scissor linkage, where said hammock body support surface (12) is attached to said first and second upright arms (2), where said first and second upright arms (2) each have a removable stop pin (16) being inserted in a lock hole disposed on the wall thereof to prevent said support frame from collapsing when in use, where there is a first leg/upright arm interface disposed on the first upright arm (2), and where there is a second leg/upright arm interface disposed on the second upright arm (2).

2. A portable hammock as defined in claim 1 further comprising:

a plurality of legs (3) hingedly connecting with each of said leg/upright interfaces (14), where two X-scissor linkages in series are disposed between said first and second upright arms (2), where said each leg/upright interface (14) is slidably disposed over said each upright arm (2), and where an upper hinged end of said X-scissor linkages is attached to one of said leg/upright interfaces (14).

3. A portable hammock as defined in claim 2, where said first and second upright arms (2) each has said lock hole disposed on an inward facing wall thereof, and where said stop pins (16) are received by said lock holes, said lock holes being disposed over said leg/upright interfaces (14).

4. A portable hammock as defined in claim 2, where each of first and second upright arms (2) has a lower end hingedly connected to a lower end of said X-scissor linkages.

5. A portable hammock as defined in claim 1, where said first and second leg/upright arm interfaces (14) are disposed over said first and second upright arms (2) respectively, where each of said leg/upright arm interfaces (14) comprises:

a plurality of hinge plates (25);

a hinge pin (27); and a lock pin (24), where the hinge plates (25) have at least one hole (23) for receiving the lock pin (24).

6. A portable hammock as defined in claim 1 further comprising:

a sliding collar (15) disposed over each of said first and second upright arms (2), where only one X-scissor linkage is attached to said first and second upright arms (2) respectively, and where an upper end of the X-scissor linkage is hingedly attached to one of said sliding collars (15).

7. A portable hammock as defined in claim 6, where each of said leg/upright arm interfaces (17) is disposed at a bottom end of each of said first and second upright arms (2), where each of said leg/upright arm interfaces (17) comprises:

a plurality of hinge plates (25);

a hinge pin (27); and a lock pin (24), where the hinge plates (25) have at least one hole (23) for receiving the lock pin (24), and one of said hinge plates (25) touches a ground surface.

8. A portable hammock as defined in claim 1 further comprising:

a first rigid width maintaining bar (21); and a second rigid width maintaining bar (21), where the first and second width maintaining bars (21) prevent the body support surface (12) from collapsing widthwise.

9. A portable hammock as defined in claim 1 further comprising:

at least one wheel (4) being attached to one of the upright arms (2).

10. A portable hammock as defined in claim 1, where a first angle measured from a ground plane to said first upright arm (2) has a range of 45 to 85 degrees, and where a second angle measured from a ground plane to said second upright arm (2) has a range of 45 to 85 degrees.

* * * * *